United States Patent [19]

Peterson et al.

[11] 4,201,637

[45] May 6, 1980

[54] SACRIFICIAL ANODE APPARATUS

[75] Inventors: Marvin L. Peterson; Orwin G. Maxson, both of Ponca City, Okla.

[73] Assignee: Conoco, Inc., Ponca City, Okla.

[21] Appl. No.: 960,904

[22] Filed: Nov. 15, 1978

[51] Int. Cl.[2] ..... C23F 13/00

[52] U.S. Cl. ..... 204/148; 204/197; 204/225

[58] Field of Search ..... 204/148, 197, 225

[56] References Cited

U.S. PATENT DOCUMENTS

| | | | |
|---|---|---|---|
| 64,992 | 5/1867 | Matthew | 204/197 |
| 2,666,026 | 1/1954 | Gibbs | 204/197 |
| 2,870,079 | 1/1959 | McCall | 204/197 |
| 2,916,429 | 12/1959 | Vossnack et al. | 204/196 |
| 3,002,909 | 10/1961 | Heidt | 204/197 |
| 3,012,958 | 12/1961 | Vixler | 204/197 |
| 3,108,940 | 10/1963 | Holdsworth | 204/148 |
| 3,616,418 | 10/1971 | Anderson | 204/196 |
| 3,616,421 | 10/1971 | MacKintosh | 204/197 |
| 3,954,591 | 5/1976 | Conkling | 204/196 |
| 4,038,168 | 7/1977 | Higuchi et al. | 204/197 |
| 4,056,446 | 11/1977 | Vennett | 204/197 |
| 4,089,767 | 5/1978 | Sabins | 204/197 |

*Primary Examiner*—T. Tung

*Attorney, Agent, or Firm*—Bayless E. Rutherford, Jr.

[57] ABSTRACT

A sacrificial anode apparatus for providing cathodic protection of metal structures, especially steel offshore platforms, is disclosed. The anode apparatus comprises (a) container for anode material, (b) anode material, and (c) means for continuously and/or periodically conveying said anode material to said container.

9 Claims, 2 Drawing Figures

SACRIFICIAL ANODE APPARATUS

BACKGROUND

1. Field of the Invention

The invention is in the field of providing cathodic protection of metal structures, especially steel offshore platforms, by the use of sacrificial anodes.

2. General Background

Sacrificial anodes and/or impressed current anodes are used on most offshore steel structures to prevent or reduce seawater corrosion of the steel. Generally these anode systems must be installed during platform fabrication. Replacement while the structure is located in the sea is difficult and expensive because divers must be used and work in deep water must be limited because of the high cost and danger to the workmen. In an effort to provide adequate protection, many very large sacrificial anodes are required to protect a structure for a typical lifetime of 20–40 years. The additional weight and wave forces on the anodes can become quite significant.

Our invention represents an improvement over the prior art in that it is an apparatus wherein the sacrificial anodes can be replenished periodically or continuously by a simple process.

BRIEF SUMMARY OF THE INVENTION

Briefly stated, the present invention is directed to a sacrificial anode apparatus, for use on a steel offshore platform, said apparatus comprising:

(a) a container for anode material, at least a portion of said container being of electrically conductive material, said container being electrically connected to the steel structure of said offshore platform, (b) anode material in said container, and (c) means for conveying said anode material to said container.

In one aspect the invention is directed to an improvement in the method of providing corrosion protection to a steel offshore platform by means of sacrificial anodes electrically attached to said platform wherein the improvement comprises means of continuously and/or periodically replenishing the sacrificial anodes as they are consumed.

An important feature of our apparatus and method is that a diver is not required to replenish the anodes.

Figure 1:
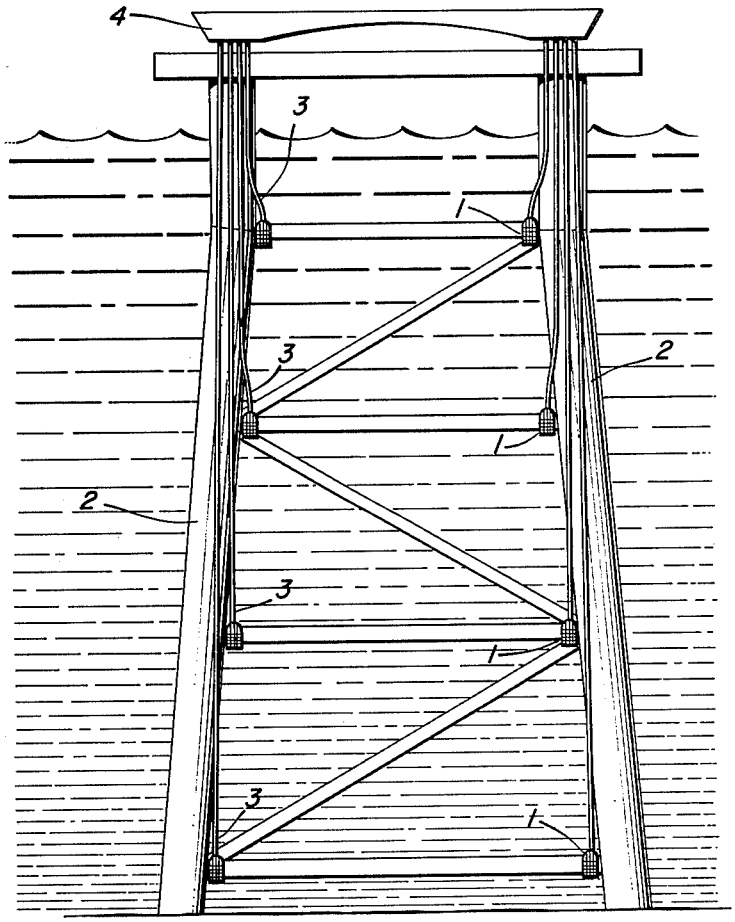
FIG. 1 is a side view of an offshore platform showing several of the sacrificial anode apparatuses located on the platform.

Referring to the drawings in FIG. 1 the container 1, which contains the anode material, is attached to a section of the offshore platform 2 by a metal clamp, welding or other suitable means. The anode material is supplied to the container by means of a tubing 3 from a source of supply 4. (The source of supply does not form a part of our invention.)

Figure 2:
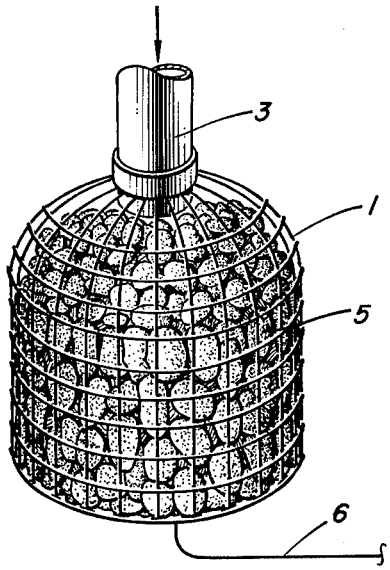
FIG. 2 is an enlarged view showing the sacrificial anode apparatus.

Referring to the drawing in FIG. 2 the container 1 is a cage constructed of 90–10 copper-nickel alloy. Inside the container are multiple pieces of anode material 5. The anode material is placed in the container by passage through the tubing 3. The container is connected to the steel platform by means of an electrical cable 6.

Details of the various components of the apparatus are provided in the following description.

DETAILED DESCRIPTION

The container for the anode material should meet the following requirements: allow the water access to the anodes and have a low weight to volume ratio consistent with being sufficiently strong to hold the anode material. A cage-like structure as shown in FIG. 2 meets these requirements. The container is fabricated out of steel, non-corrosive metal, suitable plastics or fiberglass. When constructed of a nonconductive material the container should have a bottom grill and internal sections made of conductive metal. A preferred material for preparing the container is rods of 90–10 copper-nickel alloy.

Sacrificial anodes are well-known in the art. Accordingly, the type of material used to prepare sacrificial anodes are well-known in the art. The material used for the anodes should have a higher anodic solution potential in the environment than does the metal of the structure. Since ordinarily offshore platforms are constructed of structural steel the metal anode is made of materials such as zinc, aluminum, magnesium or alloys of these materials.

The sacrificial anodes can be in a variety of shapes such as cubes, balls, cylinders and bars. The size of the anode must meet two requirements. The anode must be large enough to be retained by the cage structure of the container. Also, it must be small enough to pass through the conveying means in order to carry it from the source of supply to the container.

The conveying means for carrying the anode material from storage to the container is suitably a tube. The tube can be made of metal, preferably non-corrosive, or plastic. A plastic pipe of suitable diameter is a preferred conveying means. Preferably, each container on the platform has individual conveying means to the container. Other conveying means, which supply a plurality of containers, can be used. However, such an arrangement requires valves and controls which in turn require maintenance.

The use of this conveying means and container provides a way of simply replenishing the supply of sacrificial anodes as they become consumed. The sacrificial anodes can be replenished either continuously or periodically, as desired.

The anode material can be moved through the conveying means to the container by gravity. If necessary liquid or air pressure can be used to move the anode material to the container.

A plurality of containers containing anode material are preferably used. These are placed at various positions on the platform and are secured to the platform by any suitable means, such as a metal clamp, or welding.

Preferably, an electrical cable connects each container to the platform. Also, other means capable of conducting electricity with low resistance to current flow can be used (for example, a welded joint). The electrical cable can be used to secure the container to the platform.

Our preferred apparatus comprises the following:

Our preferred apparatus comprises the following:

(a) a container fabricated out of ½" 90–10 copper-nickel bars in the form of a cage. The cage is so constructed that it contains no space between bars greater than 2 inches. The container preferably is secured to the platform by wires made of 90–10 copper-nickel alloy, (b) anode material made of aluminum and being in the shape of rods or bars with the smallest dimension being 3 inches, (c) tubing made of plastic such as polyvinyl chloride. The tubing runs from a source of supply above water level to the container. It has a minimum inside diameter of at least 4 inches, and (d) an electrical conductor, made of steel or copper, connecting the container to the steel platform.

Thus, having described the invention in detail, it will be understood by those skilled in the art that certain variations and modifications may be made without departing from the spirit and scope of the invention as defined herein and in the appended claims.

We claim:

1. A sacrificial anode apparatus for use on a steel offshore platform, said apparatus comprising:

(a) a perforated container for anode material, at least a portion of said container being of electrically conductive material, said container being electrically connected to the steel structure of said offshore platform and being under the surface of the water, (b) particulate anode material in said container, and (c) tubing connected to said container and extending to a source of supply for conveying said anode material to said container.

2. The apparatus of claim 1 wherein the anode material is made of zinc, aluminum, magnesium or alloys of these materials.

3. The apparatus of claim 2 wherein the container is a cage-like structure.

4. The apparatus of claim 3 wherein the cage-like structure is constructed of 90–10 copper-nickel alloy.

5. The apparatus of claim 3 wherein the cage-like structure is constructed of plastic and having in the bottom portion thereof material having electrical conductive properties.

6. The apparatus of claim 4 wherein the tubing is made of plastic.

7. The apparatus of claim 5 wherein the tubing is made of plastic.

8. In the method of providing corrosion protection to a steel offshore platform by means of sacrificial anodes electrically attached to said platform the improvement comprising providing an underwater perforated container for the anodes electrically attached to said platform and supplying particulate anodes to the container by use of a tube running from the source of supply to the container.

9. The method of claim 8 wherein the tube is made of plastic.

* * * * *